United States Patent [19]

Furukawa et al.

[11] Patent Number: 4,507,015

[45] Date of Patent: Mar. 26, 1985

[54] ARRANGEMENT FOR PAVING ELASTIC SURFACE MATERIAL

[75] Inventors: Genzo Furukawa; Yutaka Sugie; Masami Fujii, all of Kobe, Japan

[73] Assignee: Sumitomo Gomu Kogyo Kabushiki Kaisha, Kobe, Japan

[21] Appl. No.: 438,880

[22] PCT Filed: Mar. 16, 1982

[86] PCT No.: PCT/JP82/00072

§ 371 Date: Sep. 30, 1982

§ 102(e) Date: Sep. 30, 1982

[87] PCT Pub. No.: WO82/03234

PCT Pub. Date: Sep. 30, 1982

[30] Foreign Application Priority Data

Mar. 16, 1981 [JP] Japan ..... 56-38247
Nov. 9, 1981 [JP] Japan ..... 56-179185

[51] Int. Cl.[3] ..... E01C 19/48

[52] U.S. Cl. ..... 404/103; 404/101; 404/104; 404/110; 404/114; 404/118; 404/122; 425/63; 425/456

[58] Field of Search ..... 404/101, 102, 103, 104, 404/105, 106, 108, 110, 113, 114, 118, 119, 120; 425/63–65, 59, 219, 54, 56

[56] References Cited

U.S. PATENT DOCUMENTS

| | | | |
|---|---|---|---|
| 1,250,809 | 12/1917 | Davis | 404/102 |
| 1,840,970 | 1/1932 | Noble | 404/102 |
| 1,909,458 | 5/1933 | Dieckmann | 404/106 X |
| 2,038,416 | 4/1936 | Clifford | 404/114 |
| 2,049,115 | 7/1936 | Hadley | 404/102 X |
| 2,054,437 | 9/1936 | Mosel | 404/105 |
| 2,089,094 | 8/1937 | Kime | 404/104 |
| 2,095,414 | 10/1937 | Hemstreet et al. | 404/104 |
| 2,162,665 | 6/1939 | Mosel | 404/105 |
| 2,185,645 | 1/1940 | Mosel | 404/120 |
| 2,413,632 | 12/1946 | Jackson | 404/104 |
| 2,832,273 | 4/1958 | Calabrese | 404/106 |
| 3,636,833 | 1/1972 | Lowen et al. | 404/105 X |
| 3,838,933 | 10/1974 | Lehman et al. | 404/114 |
| 4,280,800 | 7/1981 | Bunn | 404/103 X |

FOREIGN PATENT DOCUMENTS

| | | | |
|---|---|---|---|
| 0837990 | 6/1981 | U.S.S.R. | 404/101 |

*Primary Examiner*—James A. Leppink
*Assistant Examiner*—Beverly E. Hjorth
*Attorney, Agent, or Firm*—Robert E. Burns; Emmanuel J. Lobato; Bruce L. Adams

[57] ABSTRACT

A paving arrangement for coating a base with a self-setting synthetic molding material comprises a rigid frame in the form of a shallow box having an open bottom. The frame is supported by a pair of sleigh members mounted on the lower portion of the frame in spaced relationship from each other so that the frame can be slid over the base. One of the sleigh members is shorter than the other and has its rear end terminating forwardly of the rear end of the longer sleigh member. A hopper is mounted on the frame for storing therein the molding material. A transversely elongate outlet opening is formed at the bottom of the hopper at a position rearwardly of the rear end of the shorter sleigh member and extending in the transverse direction between the inner edge of the longer sleigh member and an imaginary extension of the outer edge of the shorter sleigh member. A screed assembly is mounted on the frame rearwardly of the hopper for compacting the molding material as it is poured from the hopper outlet opening onto the base. An auxiliary sleigh member is mounted on the frame rearwardly of the shorter sleigh member and has means for maintaining the frame in a horizontal position. By such a construction, as the paving arrangement is displaced along the base such that the shorter sleigh member moves along the lateral edge of a prior course of paved surface, the molding material poured through the hopper outlet opening is dispersed over the locus of the shorter sleigh member so that the pavement can be completed without forming joints between adjoining courses of paved surfaces.

13 Claims, 12 Drawing Figures

ARRANGEMENT FOR PAVING ELASTIC SURFACE MATERIAL

BACKGROUND OF THE INVENTION

The invention relates generally to an arrangement for paving a self-setting synthetic elastic surface material, and more particularly, to such a paving arrangement which is preferred for use in forming an athletic ground of a relatively small area such as a tennis court, or a roof-top ground of a building, or an indoor floor for rehabilitation purposes which is coated with such surface material.

It is known to form an athletic ground having a wear resistant and elastic surface by utilizing a molding material which comprises an elastic particulate aggregate such as particles of vulcanized rubber or polymerized plastics and an organic binder. Examples of such organic binder, elastic particulate aggregate or molding material are disclosed in the following prior arts:

1. U.S. Pat. No. 3,272,098
2. West German Patent Application Laid-Open No. 17 20 263
3. U.S. Pat. No. 3,801,421
4. West German Patent Application Laid-Open No. 24 47 625
5. West German Patent Application Laid-Open No. 24 48 852

An organic binder and elastic particulate aggregate are admixed together with other suitable supplemental additives to produce an unset molding material, which may be poured and laid evenly over a hard base such as asphalt or concrete, whereupon a self-setting occurs and the material is firmly bonded to the base. The setting occurs relatively rapidly, and generally after two or several days, the paved surface is capable of withstanding passage thereon. The unset molding material is a particulate mixture comprising elastic particulate aggregate on which an organic binder having an increased adherence is deposited. Such mixture is difficult to handle during the paving operation as compared with asphalt or concrete. The thickness of a surface coating layer is usually equal to or less than 50 mm, and more generally in a range from 4 to 30 mm. A conventional process of surface pavement comprises pouring unset molding material into a frame of a predetermined area, spreading it to a substantially uniform height, and smoothly compacting it with a hand tool such as a smoothing iron. Skill is required to prevent the unset molding material from adhering to the hand tool. The efficiency of operation is obviously low and the finishing accuracy is less than desirable.

An arrangement which is designed for machine paving of a self-setting synthetic surface material is proposed in aforementioned U.S. Pat. No. 3,272,098. This arrangement is in the form of a truck having wheels which run along a pair of parallel guide pieces laid over the base of a surface to be paved. One end of a screed frame which is open in triangular form is secured to the rear of the truck, and the screed frame rides the guide pieces to be guided thereby as the arrangement runs. The truck carries a binder storage tank and a hopper which receives an elastic aggregate. A mixer is also provided on the truck for admixing the binder and the elastic aggregate which are separately supplied from the tank and the hopper. An unset molding material formed by the mixing operation is dispersed through a chute within an extent defined by the screed frame, which in turn controls the height of the pavement. In a paving operation which utilizes such an arrangement, the unset molding material is spread only by the running screed, and hence there occurs no compression in practice which regulates the density of the material. Accordingly, such an arrangement is not suitable for pavement of almost any molding material for which an adjustment of the density is desirable, in particular, a molding material containing an elastic aggregate having relatively large diameter particles. While such pavement may be applicable to a playground such as a running track or a playground for handball or socker for which the surface roughness does not present a problem, it cannot be used for a tennis court which requires a fully smooth surface. Of importance is the fact that because a guide piece must be placed on each side of the paving arrangement, a joint is produced between a surface which has already been paved and another surface which is being paved in contiguous relationship with the latter. It is necessary that the joint be subsequently filled out. In addition, the arrangement is bulky, presenting difficulty in its transportation.

SUMMARY OF THE INVENTION

It is an object of the invention to provide an arrangement for paving a self-setting synthetic elastic surface material which is capable of forming a smooth paved surface with a controlled thickness of pavement and density of material.

It is another object of the invention to provide a paving arrangement which is capable of forming a paved surface adjoining a surface that has already been paved without producing a joint therebetween.

It is a further object of the invention to provide a pavement arrangement which is simple in construction and has a reduced size and weight to facilitate its transportation, and which is suitable for use in a small scale pavement such as the formation of a tennis court or a roof-top playground of a building.

A paving arrangement according to the invention comprises a frame in the form of a shallow open-bottom box which is mounted on a first and a second laterally spaced, parallel extending sleigh member in the form of steel pipes, rods or elongate strips. Guide roller means is provided on the external surface on one side of the frame for engagement with a guide rail which is arranged adjacent to the one side of the frame. The arrangement is adapted to be pulled by a winch through a wire, whereby the first and the second sleigh members slide over a base such as asphalt or concrete. In the description to follow, the direction in which the arrangement moves will be referred to as "longitudinal" direction while a direction which is perpendicular thereto will be referred to as "transverse" direction. The frame has a longitudinally elongate rectangular configuration, and carries a hopper at a location which is slightly forwardly displaced from the longitudinal center thereof for receiving an unset molding material comprising a mixture of organic binder and elastic particulate aggregate. The hopper has a transversely elongate outlet opening which is located at a predetermined elevation with respect to the surface of the base which is slightly greater than the desired thickness of the pavement. One end of the outlet opening of the hopper is located adjacent to one sidewall of the frame while the other end of the outlet opening terminates at a point which is substantially spaced inwardly from the other sidewall of the frame. The first sleigh member extends from the front to the rear end of the frame in vertical alignment with and below one side of the frame, but the second sleigh member is inwardly displaced a substantial distance from the other side of the frame and extends over a reduced distance from the front end of the frame to the other end of the outlet opening of the hopper. More particularly, the outer edge of the second sleigh member is aligned with a lateral edge which defines the other end of the outlet opening of the hopper, and the rear end of the second sleigh member terminates at the front edge of the outlet opening at the other end thereof. In this manner, an unset molding material supplied to the hopper is dispersed over the locus of the second sleigh member.

Accordingly, if the frame is guided so that the outer edge of the second sleigh member contacts the edge of the adjoining surface which has already been paved, the molding material can be dispersed without leaving a joint gap between the both surfaces. In this instance, a rear wall of the hopper which forms a part thereof acts as a squeegee for the unset molding material which is poured onto the base through the outlet opening of the hopper. An automatic screed assembly is mounted on the frame rearwardly of the hopper, and essentially comprises an inclined screed panel acting upon the unset molding material which is poured onto the base through the outlet opening of the hopper, support means for attaching the screed panel to the frame in a manner to permit its movement, and means for urging the screed panel so as to cause the latter to compress the unset molding material. As the unset molding material is poured onto the base through the outlet opening of the hopper, the squeegee action of the rear wall of the hopper causes the material to form a non-compacted layer of a thickness which is greater than the desired height of the pavement, and such layer is smoothed and compacted to the desired height by the screed panel as the arrangement moves.

In a preferred embodiment of the invention, the rear wall of the hopper which provides the squeegee action is supported so as to be vertically movable with respect to the frame, and a squeegee adjuster is associated therewith for maintaining the rear wall at a predetermined elevation. In this manner, the unset molding material which is dispersed onto the base from the hopper can form a non-compacted layer of a suitable thickness which may be desirable in connection with the desired height of pavement and the desired density of material. The screed panel of the automatic screed assembly compacts the non-compacted layer of molding material under pressure applied thereto and/or by gravity, thus converting the layer into a paved surface layer having a desired density of material and a desired height. A preferred form of automatic screed assembly includes a screed adjuster which limits the minimum elevation or the maximum approach of the screed panel to the base. By controlling the screed adjuster, there is obtained a paved surface layer of a desired height which is substantially equal to the minimum elevation or the maximum approach of the screed panel. However, without providing any special limitation on the minimum elevation or the maximum approach of the screed panel with respect to the base, an alternative arrangement may be used which allows the pressure applied to the panel or the gravity thereof to be directly applied to the molding material. In this instance, the front end of the screed panel is pivotally mounted on the frame to allow the rear end thereof to hang down on the molding material. It is preferred that the screed assembly be constructed as a so-called "dynamic screed" to apply a shearing force between the screed and a self-setting synthetic molding material having an increased viscosity, thereby preventing the molding material from adhering to the screed. In its simplest form, a dynamic screed comprises a vibrator mounted on the screed panel so that the latter may be excited for oscillation in the vertical direction with a frequency determined by the vibrator. Where the screed panel is used which is pivotally mounted on its front end and which has its other end falling down, such panel may be caused to experience a reciprocating motion in the transverse direction. In the above description, the screed has been described assuming a panel form, but it should be understood that it may be formed as a roller or rollers. In this instance, it is desirable that the screed roller be driven at a higher number of revolutions than the number of revolutions which would naturally occur as a result of the movement of the arrangement, thereby producing a shearing force acting between the roller and the molding material.

BRIEF DESCRIPTION OF THE DRAWINGS

FIG. 9 is a top view, FIG. 10 is a cross section taken along the line X—X shown in FIG. 9 and FIG. 11 is a side elevation of a height adjuster for the shaft of a screed roller.

DESCRIPTION OF PREFERRED EMBODIMENT

Figure 1:
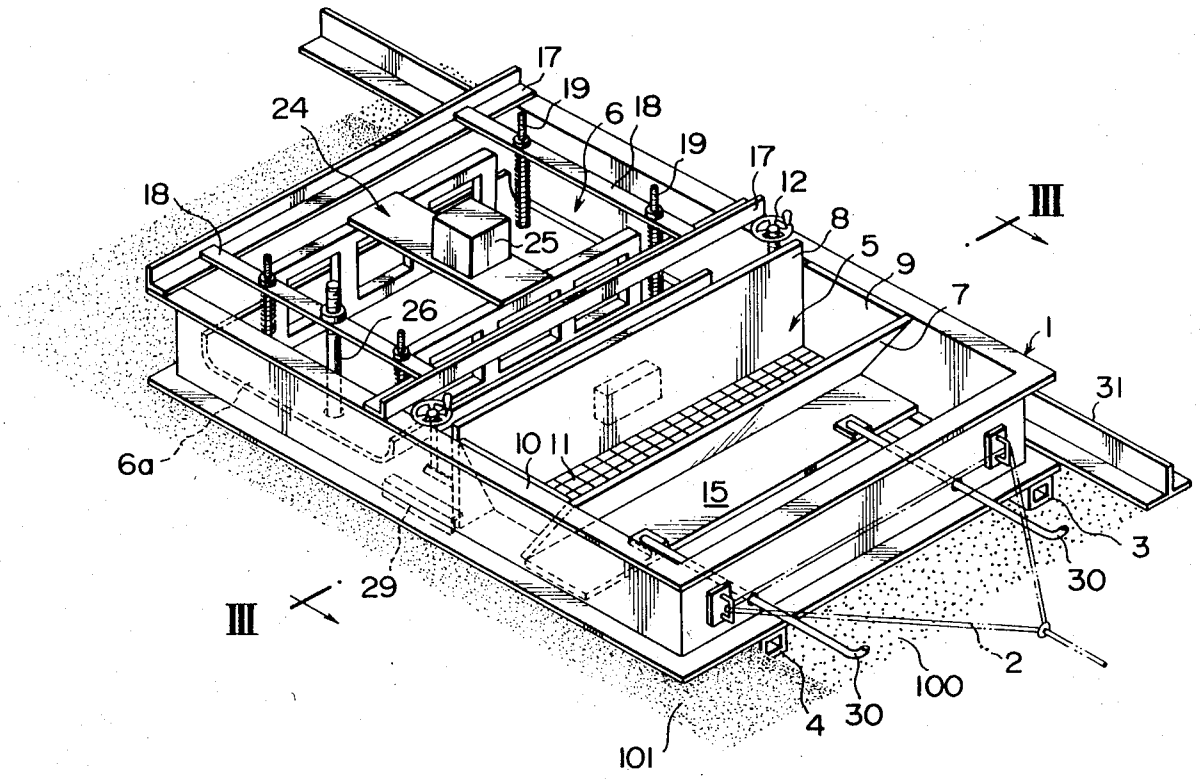
FIG. 1 is a perspective view of a paving arrangement according to the invention.
Figure 2:
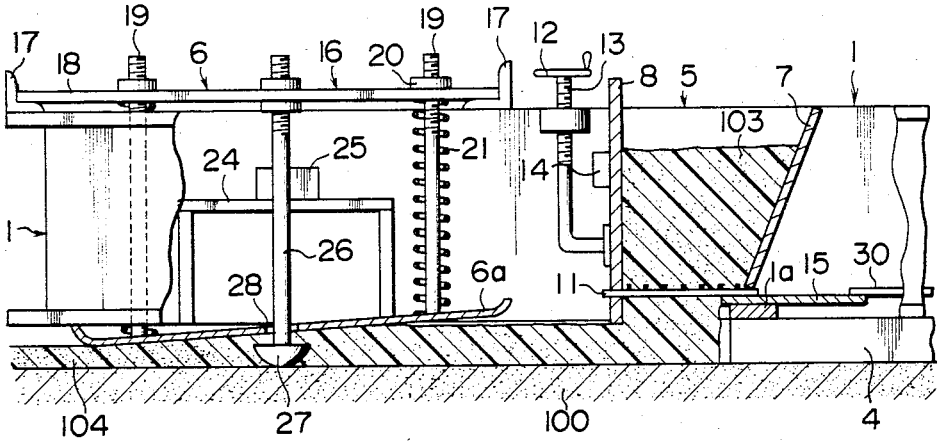
FIG. 2 is a side elevation, partly in section, of the paving arrangement shown in FIG. 1.
Figure 3:
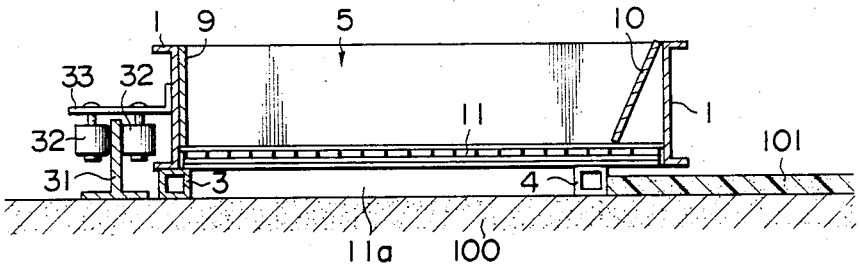
FIG. 3 is a cross section taken along the line III—III shown in FIG. 1.

Referring to FIGS. 1 to 3, there is shown a paving arrangement according to the invention including a flanged frame 1 which is formed of steel in the form of a shallow open-bottom, rectangular box. A pair of sleigh members 3, 4 formed by square steel pipes are firmly attached to the bottom of the frame 1 for maintaining it at a given elevation. The sleigh members 3, 4 are placed on a base 100 such as concrete or asphalt, and slide thereon as the frame 1 is pulled by a traction device such as winch, not shown, through a wire rope 2. Formed within the frame 1 are a hopper 5 for storing an unset molding material 103 which comprises a mixture of a binder and elastic particulate aggregate, and a screed assembly 6 which uniformly spreads the molding material over the base 100, on which a paved surface is to be formed, as the material is supplied through the outlet of the hopper 5. The hopper 5 is defined by a front plate 7 which is disposed at an angle so as to form a funnel shape, a rear plate 8 which is disposed oppositely thereto, and a pair of left and right sideplates 9, 10 which extend therebetween. An outlet opening 11*a* is formed in the bottom of the hopper 5 and carries a sieve plate 11 therein which has relatively large meshes. It is to be noted that one of the sideplates, 9, is disposed in facial contact with one of the sidewall of the frame 1 while the other sideplate 10 is disposed at an angle with respect to the other sidewall of the frame 1. The rear plate 8 functions as a squeegee plate which adjusts the thickness of the molding material as the latter is fed through the outlet opening 11*a* of the hopper 5 onto the base 100. Specifically, the rear plate 8 is connected to one end of an elevation adjusting threaded shaft 13 (see FIG. 2) carrying a handle on its other end, thus allowing the rear plate to be adjusted vertically with respect to the frame 1 by turning the handle 12. While not shown, the opposite sidewalls of the frame 1 are preferably formed with guide grooves for the rear plate 8. A vibrator 14 is mounted on the rear surface of the rear plate 8, and one end of the sieve plate 11 is connected to the rear plate 8 adjacent to the lower end thereof. It is to be understood that a terminal box associated with a power supply is mounted on the frame 1 for connection with the vibrator 14 through lead wires, although it is not specifically shown in order to simplify the illustration. The terminal box is fed through an electrical cable. When the vibrator 14 is energized, an oscillation is transmitted to the sieve plate 11 as well as the rear plate 8, whereby the unset molding material 103 within the hopper 5 is smoothly supplied onto the base 100 to be paved, through the sieve plate 11, without producing a so-called bridge phenomenon. On the other hand, a shutter plate 15 is slidably mounted on the frame 1 and is associated with the hopper 5 for adjusting the hopper opening. Connected to the shutter plate 15 are a pair of operating rods 30 which extend through the front wall of the frame 1 and forwardly thereof. While the rear plate 8 of the hopper 5 is utilized as a squeegee plate in this embodiment, it is understood that an independent squeegee plate which is adjustable in its elevation may be provided between the hopper 5 and the screed assembly 6, and such squeegee plate may be caused to oscillate in the transverse direction which is perpendicular to the direction of travel of the frame 1. When oscillation is applied to the squeegee plate, a turning up of the molding material from the base 100 as a result of pulling effect can be prevented in the event the molding material is laid down to a reduced thickness or where the binder has an increased value of viscosity.

Considering the sleigh members 3, 4, it is to be noted that one of them, 3, extends longitudinally over the full length of the frame 1 while the other sleigh member 4 which is located in facing relationship with the surface 101 that has already been paved extends from the front toward the rear end of the frame 1, but terminates short of the outlet opening 11*a* of the hopper 5. The rear end of the shorter sleigh member 4 is firmly secured to a support plate 1*a* extending across the opposite sidewalls of the frame 1. It is to be noted that the outer edge of the shorter sleigh member 4 is located in substantial alignment with an extension of the lateral edge of the outlet opening 11*a* of the hopper 5 in order to provide a seamless finish of the boundary with the surface 101 that has already been paved (see FIG. 3). As mentioned previously, the sleigh members 3, 4 are formed of steel pipes of a rectangular cross section, but they may be formed by L-shaped angular steels. The provisions of such sleigh members 3, 4 allows a smooth paved surface to be finished without being effectively influenced by the unevenness in the surface of the base 100 as the frame 1 travels while providing a modification for such unevenness.

The screed assembly 6 includes a screed panel 6*a* which is mounted on the frame 1 in a movable manner by means of hanging support unit 16. The unit 16 includes a pair of parallel transverse ledges 17 and a pair of longitudinal ledges 18 extending thereacross. Four support rods 19 are fixedly mounted on the rear surface of the screed panel 6*a* at four corners thereof to permit the screed panel to be mounted on the longitudinal ledges 18 in a manner to permit an adjustment of its elevation. Specifically, each support rod 19 comprises a threaded shaft, which extend through an opening formed in the longitudinal ledge 18 to be threadably engaged with a nut 20. A coiled suppression spring 21 is coaxially interposed around each support rod 19 intermediate the longitudinal ledge 18 and the screed panel 6*a*, whereby the screed panel 6*a* is normally urged to a minimum elevation or a maximum proximity to the base 100. However, as the screed panel 6*a* is spring loaded, it can be forced upward against the resilience of the coiled spring 21. On the other hand, the screed panel 6*a* includes a rack 24 comprising a pair of forward and rearward vertical frames which are firmly fixed on the back side of the panel and a mounting plate extending therebetween, with a vibrator 25 mounted on the rack 24. It is to be understood that the vibrator 25 is connected through lead wires to a power supply terminal box, not shown. The screed panel 6*a* has a lateral dimension which is greater than that of the outlet opening 11*a* of the hopper 5 so that it extends over the lateral edge of the surface 101 that has already been paved during the final phase of a compacting process for an unset molding material which is being supplied onto the base 100 through the outlet opening 11*a*. While not shown, means for heating the screed panel 6*a* may be provided in accordance with the invention for reducing the tendency of the unset molding material to adhere to the screed panel 6*a*. Such heating means may comprise a burner which blows a heated air to the rear surface of the screed panel 6*a* or an oil bath containing an oil supply at an elevated temperature. When the screed panel 6*a* is heated in this manner, the viscosity of the binder is reduced, thus improving the so-called "ironing effect". The effect of such heating is significant particularly during the winter period when the binder viscosity is high. A preferred heating temperature ranges from about 50° C. to a value which prevents a thermal decomposition of the binder, for example, 150° C.

In the described arrangement, the shorter sleigh member 4 is disposed inward of the frame 1 and terminates short of the outlet opening 11*a* of the hopper 5 so that the rear end portion of the frame 1 located on one side which is in alignment with the extension of the sleigh member 4 is floating with respect to the base 100, and may tend to be distorted as a result of the gravity of the screed assembly 6 which is applied to such portion. To prevent such distortion, the frame 1 is formed of a material having a high rigidity and in a construction not susceptible to distortion in the direction of elevation while simultaneously providing a balance of weight between the front and the rear portion of the frame 1. This might result in an increased size and an increased weight of the arrangement. Such disadvantage can be avoided by adopting such approach together with the provision of an elevation adjusting rod 26 which is effective to maintain a rear portion of the frame 1 which is aligned with the shorter sleigh member 4 at a given elevation. The elevation adjusting rod 26 is mounted so that it extends through one of the ledges 18 and through an opening 28 formed in the screed panel 6a to reach the base 100 which defines a surface to be paved, with a semi-spherical or boat-shaped slide 27 fixedly mounted on its lower end. The frame elevation adjusting rod 26 with the slide 27 is effective as an auxiliary sleigh member located in alignment with the sleigh member 4 for maintaining the frame 1 in its horizontal position. The slide 27 will shove aside the molding material as the latter is poured onto the base 100 through the outlet opening 11a of the hopper 5 during the movement of the frame 1, but any resulting trace can be completely amended by the trailing end portion of the screed panel 6a. The removal of such trace is facilitated by the reduced size of the slide 27 and the elastic recovery of the molding material. The friction of the slide 27 with respect to the base 100 can be reduced to a relatively small magnitude by employing the weight balancing mentioned above to alleviate the loading applied to the slide 27.

As shown in phantom line in FIG. 1, an anti-spread plate 29 in the form of an inverted L-shaped steel member is disposed below the sidewall of the frame 1 which is located nearer the already paved surface 101 in a region between the hopper 5 and the screed 6, thereby preventing an undesirable spreading of the molding material as it is supplied onto the base 100 through the outlet opening 11a of the hopper 5.

Figure 4:
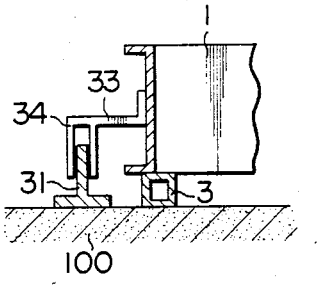
FIGS. 4 and 5 are cross sections illustrating modifications of guide means.
Figure 5:
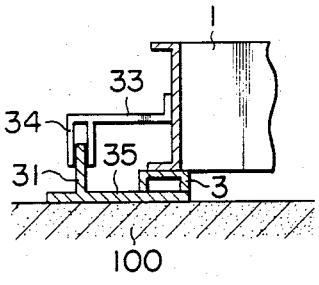

The arrangement is provided with guide means for guiding a direct movement of the frame 1 along a predetermined path as it is pulled by a traction unit such as winch, for example. The guide means comprises a pair of guide rollers 32 disposed for engagement with a guide rail 31 having an inverse T-shaped cross sectional configuration and which is installed on the base 100 at a given spacing from and in parallel relationship of the boundary with the paved surface 101, and a support bracket 33 secured to the side of the frame 1 and carrying these rollers. It will be noted that the both guide rollers 32 are mounted so as to engage the opposite sides of the guide rail 31 so that they cannot be disengaged from the rail 31 if the frame 1 happens to oscillate up and down slightly. FIGS. 4 and 5 show modifications of the guide means. In FIG. 4, the guide rollers 32 are replaced by sliders 34 which are integrally formed with the bracket 33 and having an inverted U-shaped cross sectional configuration so as to be in sliding contact with the opposite sides of the guide rail 31. In FIG. 5, the guide rail 31 has its flange 35 extended so that the longer sleigh member 3 slides over the extension of the flange 35.

The use of the arrangement of the invention will now be described. Before use, the handles 12 and the operating rods 30 are utilized to adjust the elevation of the rear plate 8 (squeegee plate) of the hopper 5 and to adjust the magnitude of the outlet opening 11a of the hopper 5 through a shifting of the shutter plate 15. An electrical cable leading to the power supply terminal box (not shown) located on top of the frame 1 is connected to a suitable external electrical power source. A pile of unset molding material including binder and elastic particulate aggregate previously mixed together is supplied into the hopper 5. After starting the vibrators 14, 25, the frame 1 is pulled through the wire rope 2 by means of a winch, not shown. The frame then begins to move linearly along the guide means comprising the guide rail 31 and the guide rollers 32, thus allowing the hopper 5 to supply a given amount of molding material through the sieve plate 11 onto the base 100 to be paved. Since the rear plate 8 of the hopper 5 and the sieve plate 11 are caused to oscillate by means of the vibrator 14, the molding material is smoothly supplied without involving a bridge phenomenon within the hopper 5. The rear plate 8 of the hopper 5 which operates as a squeegee plate spreads the molding material against the surface to be paved. Subsequently, the screed panel 6a which is located behind the hopper and having the vibrator 25 mounted thereon compacts the spread molding material to a given height. In this manner, a uniform and smooth self-setting synthetic elastic surface layer 104 is formed in strip form on the surface to be paved. Adjacent surface layers are successively formed to cover the entire surface to be paved. A seamless finish for the boundary with the paved surface 101 can be achieved by locating the arrangement so that the outer edge of the shorter sleigh member 4 slides along the lateral edge of the paved surface 101. As mentioned previously, the shorter sleigh member 4 terminates short of the front end of the outlet opening of the hopper 5, so that if it is guided to move along the boundary with the paved surface 101, the lateral edge of the outlet opening 11a of the hopper 5 will be just located on the boundary, whereby the molding material which is poured onto the base 100 through the outlet opening 11a covers the locus of the shorter sleigh member 4.

Figure 6:
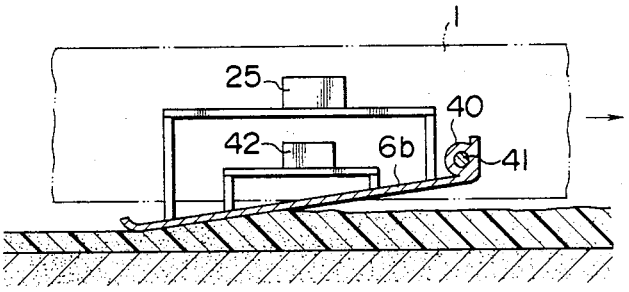
FIGS. 6 and 7 are side elevations of automatic screed assemblies which are slightly different from that shown in FIG. 1.
Figure 7:
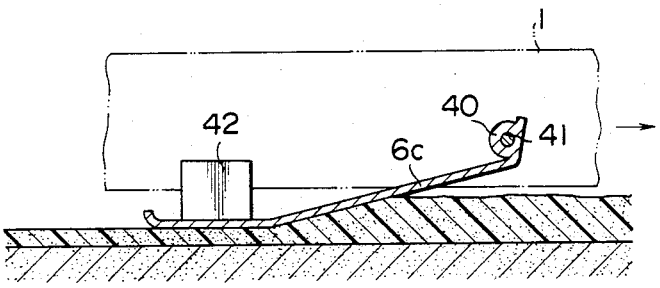
Figure 8:
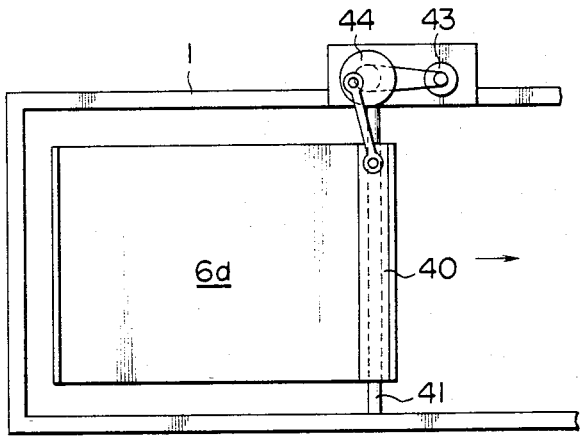
FIG. 8 is a plan view of another modification of automatic screed assembly.
Figure 9:
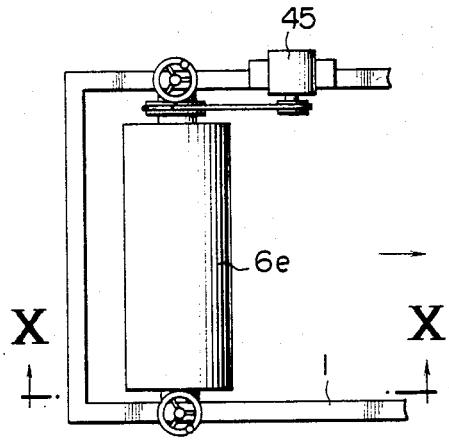
FIGS. 9, 10 and 11 illustrate another modification of automatic screed assembly
Figure 10:
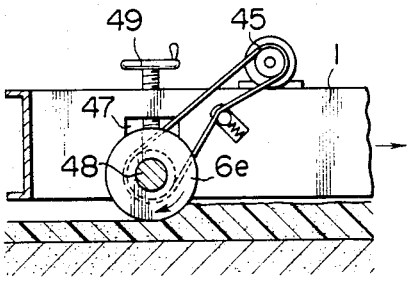
Figure 11:
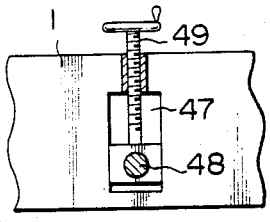

In the embodiment described above, the screed assembly 6 of a special construction has been employed. However, a variety of screeds can be used in carrying out the invention, as will be described below. Specifically, FIGS. 6, 7 and 8 illustrate different forms of screed assemblies, all of which have a common feature in that each screed panel 6b, 6c or 6d carries a bearing 40 on its front end, through which it is pivotally mounted on a horizontal rotary shaft 41 extending across the opposite sidewalls of the frame 1. In FIG. 6, a weight 42 is placed on the back side of the screed panel 6b in addition to the vibrator 25. The screed panel 6b allows the application of a synergetic compression effect, produced by the oscillation of the vibrator 25 and the weight 42, to be applied to the molding material being laid down. In FIG. 7, the only loading applied to the screed panel 6c is produced by the weight 42, which can be effective to provide a smooth pavement depending on the viscosity of the binder. It is desirable that the magnitude of the weight 42 can be adjustably selected depending on the work conditions. The screed panel 6d shown in FIG. 8 is also slidable along the support shaft 41 and is operatively connected to a disc crank mechanism 44 which translates a rotary motion from a motor 43, serving as a drive source, into a rectilinear motion. Accordingly, the screed panel 6d smoothly spreads or levels the molding material while reciprocating transversely or in a direction perpendicular to the direction of travel of the frame 1 or along a guide rail defined by the rotary shaft 41. To simplify the illustration, a vibrator or a weight as illustrated in FIGS. 6 and 7 are not shown as placed on top of the screed panel 6d, but it should be understood that the panel may be provided with these components. Referring to FIGS. 9, 10 and 11, there is shown a screed assembly of the shear roller type. It includes a screed roller 6e which is rotatably supported by the frame 1 and is driven by a motor 45 which is fixedly mounted on the frame 1. As driven by the motor 45, the roller 6e rotates at a rate which is higher than the rate with which the roller 6e would rotate as the frame 1 travels forward, thus causing a strong shearing force to be applied between the roller 6e and the molding material. The screed roller 6e has a rotary shaft 46 which has its opposite ends supported by bearing members 48 which are in turn slidable in a guide opening 47 formed in the frame 1. By operating threaded shafts 49 which are connected with the bearing members by means of handles, their elevation can be adjusted.

Figure 12:
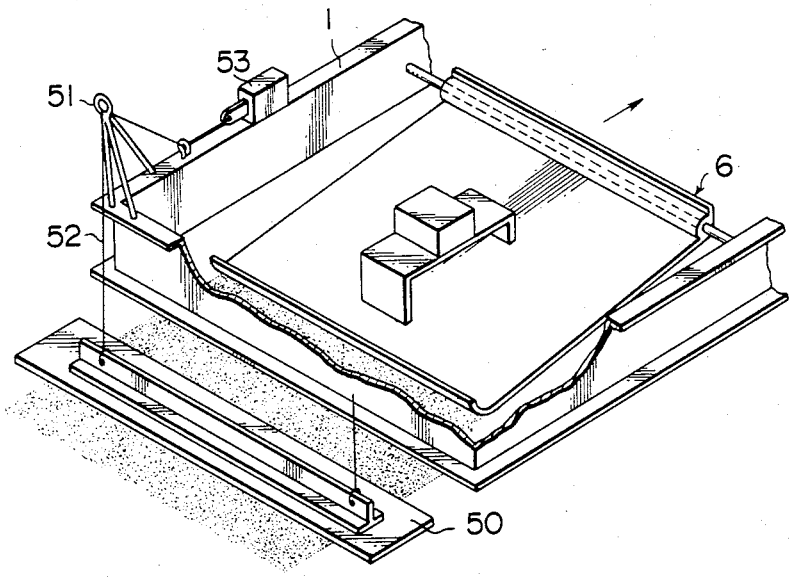
FIG. 12 is a perspective view of a tapper unit which can be additionally provided in the paving arrangement shown in FIG. 1.

FIG. 12 schematically illustrates a tapper assembly which can be additionally provided in the paving arrangement of the invention. The assembly includes a tapper plate 50 which is operative to tap gently the surface of a layer levelled by the screed 6. The molding material which has been compacted by the screed 6 tends to recover slightly under its own resilience immediately after it has been released from the trailing edge of the screed 6, and when viewed microscopically, the corners of elastic aggregate contained in the molding material project above the surface, whereby the paved surface exhibits a lustreless pattern. The purpose of the tapper plate 50 is to correct for this by providing a final clear finish for the paved surface. It is suspended by ropes 52 extending through eyelets formed in mast-shaped suspension arms 51 which are fixedly mounted on the rear end of the frame 1, the ropes being connected to solenoid assemblies 53. Thus, as the solenoid assemblies 53 intermittently pick up, the tapper plate 50 is raised to a given elevation and then falls down by gravity, producing a gentle tapping action which drives the corners of the elastic aggregate flat against the surface. While only one solenoid assembly is shown in FIG. 12 for convenience of illustration, it should be understood that in practice, a pair of them are provided on the opposite sides of the frame 1.

While several preferred embodiments of the invention have been described in detail above, it should be understood that they are exemplary only and are not limitative of the scope of the invention. While the invention is directed to an arrangement which is suitable for paving a self-setting synthetic elastic surface material, it is also applicable to the pavement of other molding materials which are similar in nature to such surface material. While the use of a winch to pull the frame 1 has been described above in connection with the embodiment, automatic running means may be provided laterally of the frame 1, namely, on the side on which the guide means is provided.

What is claimed is:

1. A paving arrangement for coating a base with a molding material comprising:

a rigid frame in the form of a shallow box having an open bottom;

a first longer sleigh member and a second shorter sleigh member of an equal height mounted on the lower portion of the frame in spaced relationship from each other for sliding over the base as the frame is pulled by a traction unit during use of the paving arrangement, the shorter sleigh member having its rear end terminating forwardly of the rear end of the longer sleigh member;

a hopper located at an intermediate position within the frame, the hopper having a front wall, a rear wall and a pair of sidewalls and having a transversely elongate outlet opening in its bottom, the outlet opening being positioned rearwardly of the rear end of the shorter sleigh member and extending in the transverse direction between the inner edge of the longer sleigh member and an imaginary extension of the outer edge of the shorter sleigh member, the molding material being received and stored in the hopper so as to be poured onto the base through the outlet opening;

a screed assembly located within the frame at a location rearwardly of the hopper for compacting the molding material to a given height as it is poured onto the base through the outlet opening of the hopper;

and an auxiliary sleigh member supported by the frame at a location rearwardly of the shorter sleigh member, the auxiliary sleigh member being located between the hopper and the rear end of the screed assembly and having means for maintaining the frame in its horizontal position.

2. A paving arrangement according to claim 1, further comprising guide means fixedly mounted outside one sidewall of the frame adjacent which the longer sleigh member is mounted, the guide means engaging a guide rail laid over the base for guiding the paving arrangement to move along a predetermined path.

3. A paving arrangement according to claim 1 in which the rear wall of the hopper has its lower end disposed at a given elevation with respect to the base, whereby the rear wall operates as a squeegee which spreads the molding material as it is poured onto the base through the outlet opening.

4. A paving arrangement according to claim 3 in which the rear wall of the hopper is supported so as to be vertically movable with respect to the frame, and further including squeegee adjusting means which adjust the elevation of the lower end of the rear wall with respect to the base.

5. A paving arrangement according to claim 4 in which a vibrator for transmitting vibration to the rear wall is mounted on the outside of the rear wall.

6. A paving arrangement according to claim 1 in which the hopper includes a sieve plate disposed within the outlet opening thereof and a shutter plate which adjusts the size of the outlet opening.

7. A paving arrangement according to claim 1 in which the screed assembly comprises a screed panel disposed for contact with the molding material which is poured onto the base, support means for mounting the screed panel in a movable manner with respect to the frame, and means for loading the screed panel so that the screed panel compacts the molding material, the support means including a plurality of stanchions fixedly mounted above the screed panel, a bridge member fixedly connected to the frame, and a screed elevation adjuster for mounting each of the stanchions on the bridge member so as to be movable in the axial direction of the stanchions, the loading means comprising a plurality of coiled compression springs coaxially disposed on each of the stanchions and extending between the screed panel and the bridge member.

8. A paving arrangement according to claim 7 in which the screed assembly includes a vibrator which is mounted on the screed panel for causing a vibration of the screed panel in the vertical direction.

9. A paving arrangement according to claim 1 in which the screed assembly includes a screed panel which is disposed at an angle from its front toward its rear end with respect to the base and which is disposed for contact with the molding material as it is poured onto the base, a support shaft for rotatably mounting the front end of the screed panel on the frame, and a weight for loading the screed panel to cause it to compact the molding material.

10. A paving arrangement according to claim 9 in which the screed assembly includes a vibrator mounted on the screed panel for causing at least the rear end portion of the screed panel to vibrate in the vertical direction.

11. A paving arrangement according to claim 1 in which the screed assembly includes a screed panel disposed at an angle from its front toward its rear end with respect to the base and which is disposed for contact with the molding material as it is poured onto the base, a support shaft for mounting the front end of the screed panel on the frame in a rotatable and transversely slidable manner, and drive means for imparting a reciprocating motion of the screed panel along the axis of the support shaft.

12. A paving arrangement according to claim 1 in which the screed assembly includes a roller which rolls over the molding material under pressure as the material is poured onto the base, a bearing for rotatably supporting the roller on the frame, a screed elevation adjuster for adjusting the elevation of the bearing with respect to the frame, and a drive for rotating the roller, the drive being constructed to rotate the roller at a higher number of revolutions than the number of revolutions with which the roller would rotate as the frame travels.

13. A paving arrangement according to claim 1, further comprising a tapper assembly located rearwardly of the screed assembly, the tapper assembly including a flat tapper member disposed for periodic contact with the surface of the molding material as compacted by the screed assembly, and a drive for periodically driving the tapper member.

* * * * *